US007455374B2

(12) United States Patent
Nachbaur et al.

(10) Patent No.: US 7,455,374 B2
(45) Date of Patent: Nov. 25, 2008

(54) ARRANGEMENT FOR CONNECTING A DRAWER FRAME TO THE BOTTOM OF A DRAWER

(76) Inventors: Jürgen Nachbaur, Mozartstrasse 18, A-6845, Hohenems (AT); Günter Grabher, Eichwald 20, A-6972, Fussach (AT)

( * ) Notice: Subject to any disclaimer, the term of this patent is extended or adjusted under 35 U.S.C. 154(b) by 102 days.

(21) Appl. No.: 10/518,311

(22) PCT Filed: Jun. 16, 2003

(86) PCT No.: PCT/EP03/06349

§ 371 (c)(1),
(2), (4) Date: Oct. 7, 2005

(87) PCT Pub. No.: WO03/105631

PCT Pub. Date: Dec. 24, 2003

(65) Prior Publication Data

US 2006/0103277 A1 May 18, 2006

(30) Foreign Application Priority Data

Jun. 17, 2002 (DE) ..... 202 09 416 U

(51) Int. Cl.
*A47B 88/00* (2006.01)

(52) U.S. Cl. ..... 312/330.1; 312/334.6; 312/348.1

(58) Field of Classification Search ..... 312/330.1, 312/334.1, 334.6–334.8, 348.1, 348.2, 333, 312/331; 384/22

See application file for complete search history.

(56) References Cited

U.S. PATENT DOCUMENTS 4,875,747 A * 10/1989 Hollenstein ..... 312/330.1
5,180,217 A * 1/1993 Lautenschlager ..... 312/334.7

(Continued)

FOREIGN PATENT DOCUMENTS

DE 91 13 066 U1 12/1992

(Continued)

*Primary Examiner*—Janet M Wilkens
(74) *Attorney, Agent, or Firm*—Christa Hildebrand; Norris McLaughlin & Marcus, P.A.

(57) ABSTRACT

Arrangement for connecting a drawer frame (12) formed by a metal hallow chamber profile to the facing lateral edge of the associated plate-shaped drawer bottom (10), in which at least in part-regions of its lower end region opposite the end face of the edge of the drawer bottom (10) the drawer frame (12) has in each case a strip-shaped vertical contact web (26) for the lateral end face of the drawer bottom (10), and a supporting leg (28) which engages under the drawer bottom in the proper connection position is bent away from the lower end of the contact web. The supporting leg has integrally projecting from it fixing claws (32) which are pointed or sharpened at their free ends, project over the support surface of the supporting leg (28) and can be pressed into the material of a drawer bottom which is to be fixed. Each supporting leg (28) has at least one elongate punched-out slot (30) which is closed all round in its region between the strip-shaped contact web (26) and its free edge. The fixing claws (32) are attached integrally to one of the edges of the punched-out slot (30) and are extensions formed out of the material of the supporting leg (28) itself which are bent round substantially at right angles in the direction of the drawer bottom (10).

18 Claims, 3 Drawing Sheets

U.S. PATENT DOCUMENTS

| | | | | | |
|---|---|---|---|---|---|
| 5,364,179 | A | * | 11/1994 | Brustle et al. | 312/333 |
| 5,462,349 | A | * | 10/1995 | Grabher | 312/348.1 |
| 5,478,146 | A | * | 12/1995 | Grabher | 312/348.1 |
| 5,538,339 | A | | 7/1996 | Rock et al. | 312/348.1 |
| 5,556,183 | A | * | 9/1996 | Brustle et al. | 312/348.1 |
| 5,564,807 | A | * | 10/1996 | Rock et al. | 312/331 |
| 5,681,101 | A | * | 10/1997 | Peter | 312/330.1 |
| 5,709,444 | A | * | 1/1998 | Fitz et al. | 312/348.2 |
| 5,971,516 | A | * | 10/1999 | Huber | 312/348.1 |
| 5,992,958 | A | * | 11/1999 | Scheible | 312/348.2 |
| 6,053,592 | A | * | 4/2000 | Sutterlutti | 312/330.1 |
| 6,095,627 | A | * | 8/2000 | Sutterlutti | 312/348.2 |
| 6,378,967 | B1 | * | 4/2002 | Moser et al. | 312/334.1 |
| 6,474,761 | B1 | * | 11/2002 | Muterthies et al. | 312/348.1 |
| 6,629,738 | B2 | * | 10/2003 | Salice | 312/333 |
| 6,883,886 | B2 | * | 4/2005 | Salice | 312/348.1 |
| 2006/0049732 | A1 | * | 3/2006 | Prentner et al. | 312/334.1 |

FOREIGN PATENT DOCUMENTS

| | | | |
|---|---|---|---|
| DE | 297 09 362 | U1 | 9/1997 |
| DE | 202 03 812 | U1 | 7/2002 |
| EP | 0 429 428 | A2 | 11/1990 |
| EP | 0 888 737 | A1 | 1/1999 |

* cited by examiner

Fig. 2
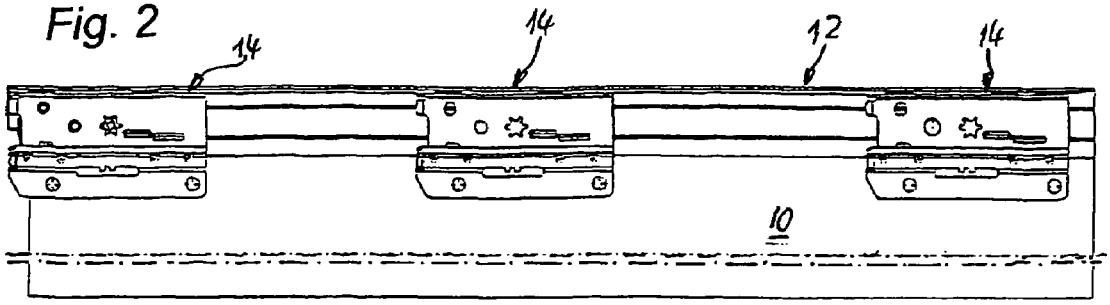
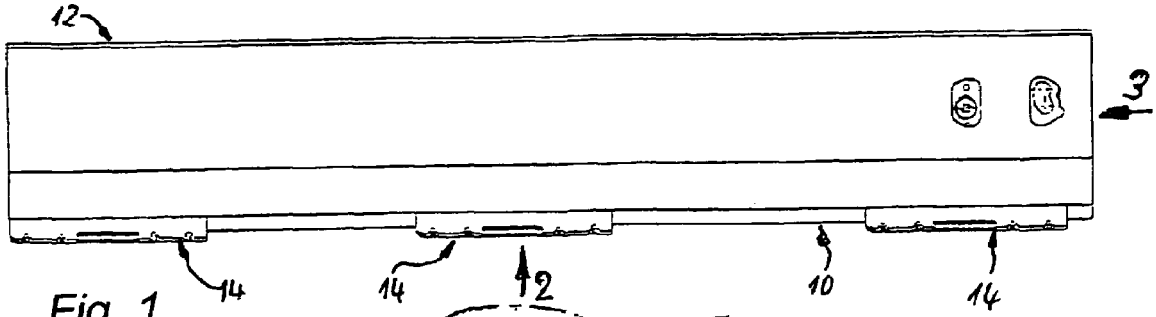
Fig. 1
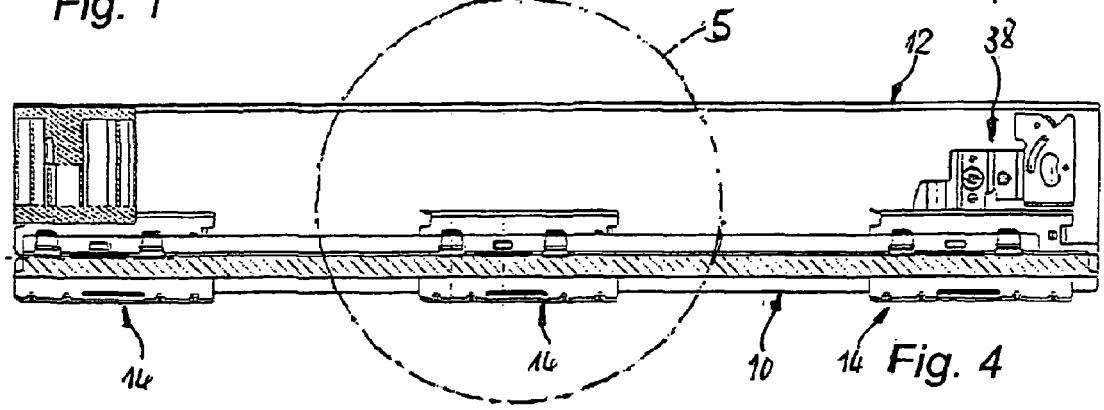
Fig. 4
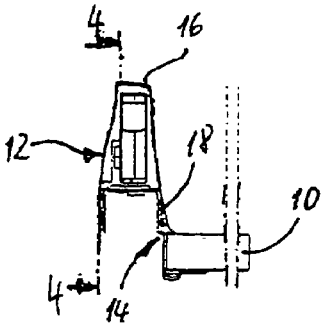
Fig. 3
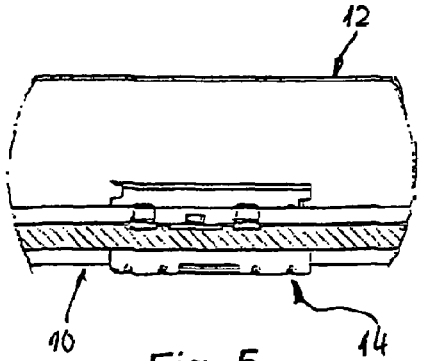
Fig. 5

Fig. 6
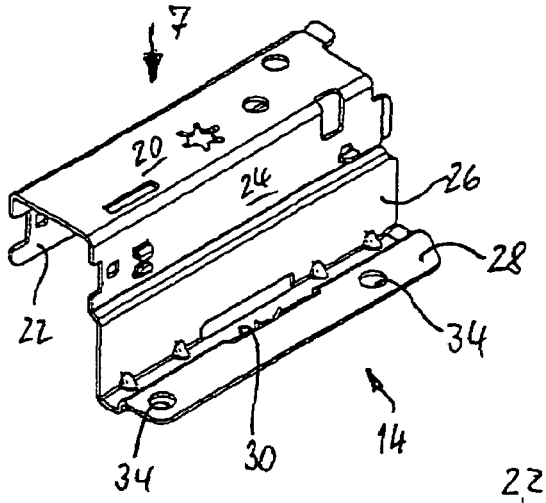
Fig. 7
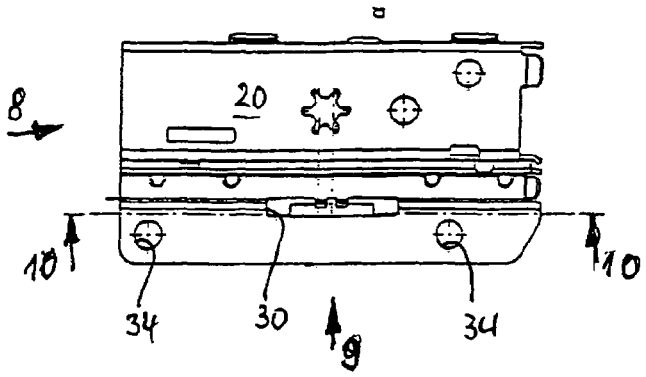
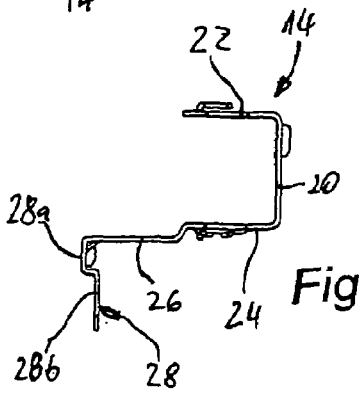
Fig. 8
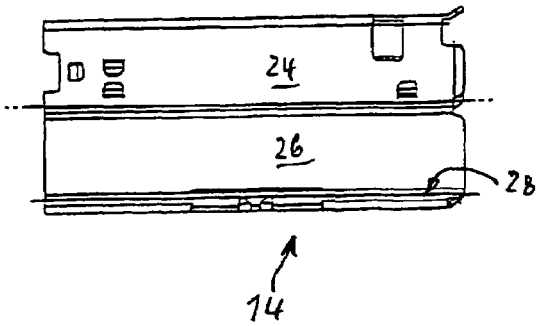
Fig.9
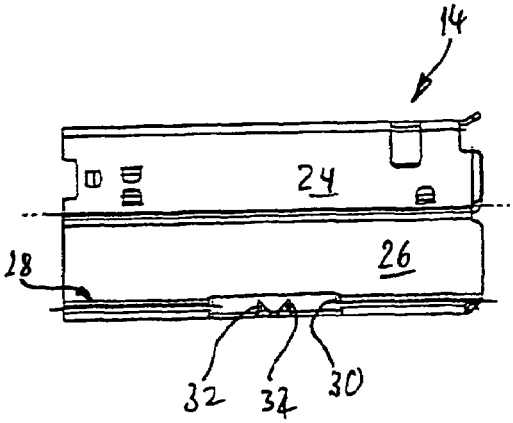
Fig,10

Fig. 11
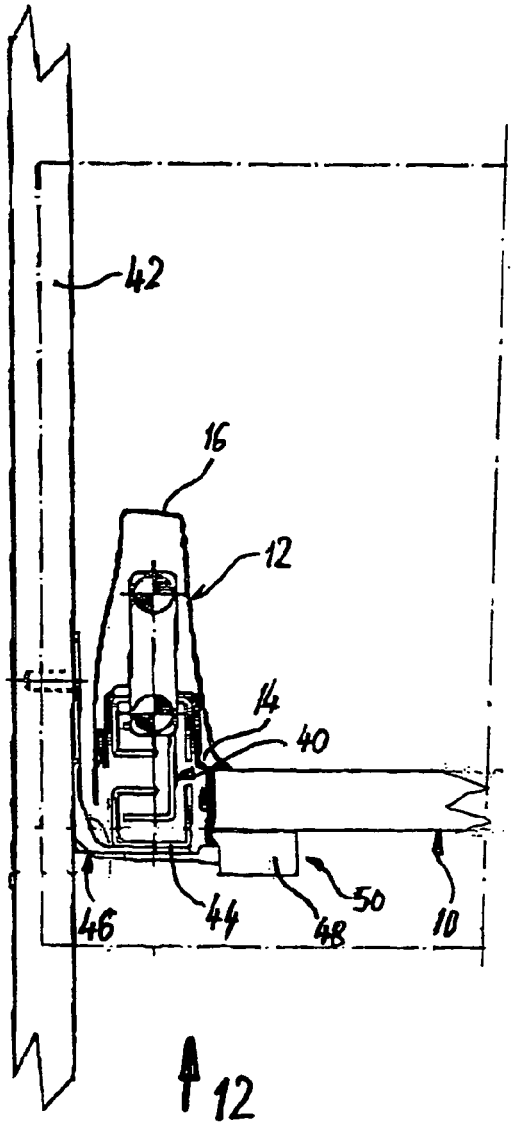
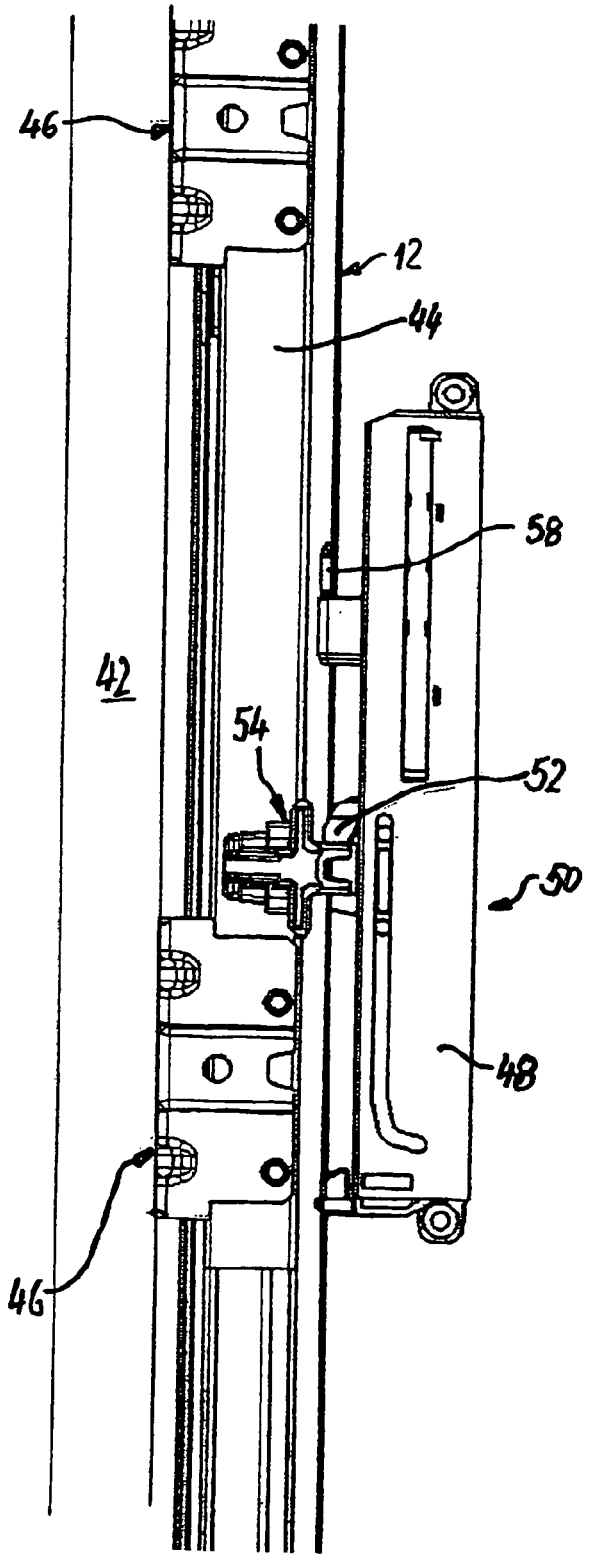
Fig. 12

ARRANGEMENT FOR CONNECTING A DRAWER FRAME TO THE BOTTOM OF A DRAWER

This is an application filed under 35 USC 371 of PCT/EP03/06349.

BACKGROUND OF THE INVENTION

The invention relates to an arrangement for connecting a drawer frame formed by a metal hollow chamber profile to the facing lateral edge of the associated plate-shaped drawer bottom, in which at least in part-regions of its lower end region opposite the end face of the edge of the drawer bottom the drawer frame has in each case a strip-shaped vertical contact web for the lateral end face of the drawer bottom, and a supporting leg which engages under the drawer base in the proper connection position is bent away from the lower end of the contact web and has integrally projecting from it fixing claws which are pointed or sharpened at their free ends, project over the support surface of the supporting leg and can be pressed into the material of a drawer bottom which is to be fixed.

In recent times, at least in the case of pieces of high-quality furniture, metal hollow chamber profiles which are cut to length for example from metal extruded profiles have been used for drawer frames or side walls. Instead of the extruded profiles which necessitate high investment costs and are therefore expensive to produce, hollow profiles produced from at least two part-profiles bent out of sheet metal have also been used recently as hollow sections for side wall frames (DE 39 34 419 C2). Hollow chamber profiles have, on their underside below the closed profile cavity, a receiving space to receive the running rail of pull-out guides. In order to receive the drawer bottom, the hollow chamber profile is provided in the region inside the drawer with a downwardly-extended contact web for the side surface of the drawer bottom and a supporting leg which adjoins this and is bent round under the drawer bottom and on which the lateral edge region of the drawer bottom rests in the fully assembled drawer. In the junction region of the inner vertical hollow profile wall with the upper face of the drawer bottom a fillet is usually formed which engages over the edge region of the upper face of the drawer bottom and prevents the drawer bottom from being lifted off from the supporting leg. In order also to prevent displacements of the drawer bottom relative to the side wall frame in the horizontal direction, e.g. in the event of jerky abutment of the drawer in the closed position, in addition to screwing the supporting leg to the drawer bottom it is also known for tabs to be cut free from the supporting leg through slots punched in from the edge, these tabs being bent round in their free end region in the direction of the drawer bottom and pointed so that they form fixing claws which can be pressed into the underside of the drawer bottom and thus secure the latter against horizontal displacement (DE 93 03 093 U1). Due to the slotting of the supporting leg which passes through to the free edge in order to form the fixing claws, the supporting leg is weakened in its loading and in its resistance to deformation. Thus it is possible that the portions of the fixing leg remaining between the fixing claws are deformed as the claws dig into the drawer bottom, so that as a result the support surface of the supporting leg on the underside of the drawer bottom is reduced and also the danger of damage to articles stored in a drawer disposed below it due to regions of the supporting leg projecting from the underside of the drawer bottom cannot be excluded.

BRIEF SUMMARY OF THE INVENTION

The object of the invention is to avoid the disadvantages set out above and moreover make possible a secure connection with a high loading capacity of the lateral edge of a drawer bottom on the associated drawer frame irrespective of the length dimensions thereof.

Starting from a connecting arrangement of the type referred to in the introduction, this object is achieved according to the invention in that each supporting leg has at least one elongate punched-out slot which is closed all round in its region between the strip-shaped contact web and its free edge, and that the fixing claws are attached integrally to one of the edges of the punched-out slot and are extensions formed out of the material of the supporting leg itself which are bent round substantially at right angles in the direction of the drawer bottom.

By the construction of the fixing claws from the material of an elongate punched-out slot which is closed all round an opening in the supporting leg to the free edge is avoided.

In a preferred variant of the invention at least one, preferably two or more connector components made from sheet metal are provided which can be installed in the underside of the drawer frame and on each of which is provided the supporting leg which engages under the drawer bottom and is provided with the fixing claws. By the use of thicker sheet material for the connector components than for the hollow chamber profile which forms the drawer frame, it is possible to ensure the required high loading capacity of the connection between the drawer bottom and the drawer frame.

In this case the contact web of the connector component is preferably of such a dimension in terms of height that in the proper fixing position of the drawer bottom on the drawer frame it projects over the underside of the drawer bottom, and that the supporting leg which projects from the lower end of the contact web under the drawer bottom has two parallel strip-shaped leg portions which are offset in height and of which the outer leg portion facing away from the contact web is offset in height relative to the inner leg portion directly adjoining the contact web by the amount by which the contact web projects over the underside of the drawer bottom in the direction back towards the drawer bottom. By the division of the supporting leg into two leg portions which are offset in height the supporting leg is additionally reinforced.

In this case it is advantageous to provide the punched-out slot in the supporting leg in the junction region between the leg regions which are offset in height, so that then the fixing claw(s) is or are attached integrally to an edge of the punched-out slot which extends parallel to the lateral edge of the drawer bottom.

It is then advantageous if at least a pair of parallel fixing claws is provided spaced from one another on each punched-out slot.

The fixing claws are then advantageously formed by tab-like extensions formed out of the material of the supporting leg in the punched-out region, and the free ends of these extensions are chamfered in such a way that they each form a pointed or sharpened edge which penetrates into the underside of the drawer bottom. In this case the chamfers of the free ends of the fixing claws advantageously extend in the opposite direction to the chamber of the respective other fixing claws, so that the free ends of the fixing claws when they penetrate into the drawer bottom are bent in the opposite direction of deformation.

At least one through hole for the shank of a fixing screw to be screwed into the drawer bottom can be provided in each case in the outer leg portion of the supporting leg of the connector components. In special cases the drawer bottom can be additionally secured against separation from the drawer frame by screwing in a fixing screw through the through hole into the drawer bottom.

The connector component is preferably a punched pressed part made from sheet metal which has in its region to be disposed in the open underside of the drawer frame a cross-section corresponding to the internal cross-section of the region of the hollow chamber profile of the drawer frame which receives the connector component.

The connector component is advantageously provided in its region to be installed in the interior of the drawer frame with fixing means for installation in the hollow chamber profile of the drawer frame, and these fixing means may be formed for example by tabs which are punched out of the material of the connector component and can be fitted or pushed onto associated carrier portions in opposing regions of the drawer frame. Disassembly of the connector components is then also possible. As an alternative, however, the connector components can also be undetachably connected to one another in another manner which is known per se, e.g. by riveting by means of blind rivets, interconnection of tongues pushed through slots in one of the components, etc.

In recent years drawers—above all in the case of pieces of high-quality furniture—have been provided with so-called "automatic retraction devices" which in order to terminate the closure process pull the respective drawer automatically into the closed position and secure it in the closed position against inadvertent opening. Therefore in an advantageous variant of the invention it is provided that the elongate low housing of an automatic drawer retraction device is disposed on the underside, facing away from the drawer bottom, of the supporting leg of one of the connector components in such a way that the pawl component thereof which triggers the retraction function projects, during the pull-out or push-in movement of the drawer, into the path of a catch which is disposed directly or indirectly on the guide rail fixed on the carcass or on a mounting thereof.

A damping device which slows down the retraction movement of the pawl component after it has been triggered by the catch is then advantageously provided in the housing of the automatic retraction device, and the damping device can be provided with a damper which is known per se and has a fluid or gaseous damping medium.

The housing of the automatic retraction device is advantageously latched with the supporting leg of the associated connector component, so that the automatic retraction device can be installed simply and quickly as required—even at a later stage.

The housing of the automatic retraction device can—depending upon the length of the retraction path as predetermined by the design—be markedly longer than the width of the supporting leg of the connector component. If this housing projects significantly over the supporting leg in the horizontal direction it is advantageous if the housing is additionally connected to the drawer frame in its region which projects over the supporting leg.

BRIEF DESCRIPTION OF THE DRAWINGS

The invention is explained in greater detail in the following description of an embodiment in connection with the drawings, in which:

FIG. 1 shows a side view directed at the outer face of a drawer frame which is connected to a drawer bottom in the manner according to the invention;

FIG. 2 shows a view from below of the underside of the drawer frame and the drawer bottom, in the direction of the arrow 2 in FIG. 1;

FIG. 3 shows a view in the direction of the arrow 3 in FIG. 1;

FIG. 4 shows a view of the connecting arrangement according to the invention which corresponds to FIG. 1 in the direction of view but is a sectional view along the arrows 4-4 in FIG. 3;

FIG. 5 shows the part-region placed within the circle 5 shown by dash-dot lines, on an enlarged scale;

FIG. 6 shows an isometric three-dimensional view of a connector component provided for connection of a drawer bottom to the appertaining side wall;

FIG. 7 shows a plan view of the connector component in the direction of the arrow 7 in FIG. 6;

FIG. 8 shows a view of the connector component in the direction of the arrow 8 in FIG. 7;

FIG. 9 shows a view of the connector component in the direction of the arrow 9 in FIG. 7;

FIG. 10 shows a sectional view of the connector component in the direction of the arrows 10-10 in FIG. 7;

FIG. 11 shows a view corresponding to the direction of view of FIG. 3 of the drawer frame connected to the drawer bottom in the manner according to the invention, in which in addition the adjacent carcass wall and the pull-out guide which is inserted into the underside of the frame and constructed as a full pull-out means and an automatic drawer retraction device provided on the underside of the drawer bottom are shown schematically; and FIG. 12 shows a view from below on an enlarged scale in the direction of view of the arrow 12 in FIG. 11.

DETAILED DESCRIPTION OF THE INVENTION

FIGS. 1 to 5 show the connection of one of the lateral edges of a drawer bottom 10 to a drawer frame 12 which forms a side wall of a drawer by means of—in the illustrated case three—connector components 14. The special configuration of the connector components is described below in connection with FIGS. 6 to 10 in which a connector component 14 is shown separately.

In the illustrated case the drawer frame 12 is formed by a hollow chamber profile which, corresponding to the previously mentioned hollow chamber profile according to DE 39 34 419 C2 is constituted by two part-profiles 16, 18 bent out of sheet metal. The connector components 14 which are likewise produced from sheet metal with a greater material thickness in a punching and pressing operation are inserted into the underside of the drawer frame which is open like a channel formed by the lower part-profile 18, whereby the region of the connector components 14 lying within the channel-like opening is constructed in cross-section to correspond in each case to the internal cross-section of the lower part-profile 18. Therefore since the connector component rests in each case over a large area on the two vertical boundary faces and also on the web faces of the part-profile 18 connecting these faces, the lower edge region of the drawer frame 12 is reinforced in each case by the connector components 14. The connector components 14 have—as can be seen in particular from FIGS. 6 and 8—in their part-region to be disposed in the open underside of the drawer frame 12 a U-shaped cross-section with a web wall 20 which has side wall portions 22, 24 in each case attached approximately at right angles on their lateral edges. A strip-shaped vertical contact web 26 is then attached to the lower edge of the side wall portion 24 near the drawer bottom and in the proper assembly position in the drawer frame rests behind the contact web for the lateral end wall of the drawer bottom 10 which is formed on the drawer frame 12.

A supporting leg 28 which is constituted by two leg portions 28*a* and 28*b* which are offset in height relative to one another and projects below the drawer base 10 which is to be installed is attached to the lower free end of the contact web 26, and of these leg portions the outer leg portion 28*b* which is further from the contact web 26 in the proper assembly position rests on the underside of the drawer bottom.

In the junction region between the leg portions 28*a* and 28*b* an elongate narrow punched-out slot 30 is provided, and from the edge of this punched out-slot formed in the leg portion 28*a* two adjacent parallel fixing claws 32, which are punched out of the material of the connector component 14 originally located in the punching-out region, i.e. are an integral component of the supporting leg 28, project upwards in the direction of the drawer bottom to be installed. In a manner which can be seen best in FIG. 10, the fixing claws 32 are chamfered in the region of their free ends in opposite directions in each case, so that the discernible pointed ends are produced which during the installation of the drawer bottom 10 are pressed in to engage in the underside of the drawer bottom by interlocking.

In the web wall 20, as in the vertical side wall portions 22 and 24 attached to the edges thereof, various punched-out slots or cut-out tabs which can be seen in the drawings are provided for fixing the connector components 14 in the open underside or also as fixing openings for further fittings which are to disposed in the upper closed cavity of the drawer frame 12, but are not described in detail here because they merely illustrate examples of possible fixing means and can be replaced by other possible fixing means. The actual subject of the invention is the described arrangement and construction of the fixing claws 32 which penetrate into the drawer bottom during assembly.

In the outer leg portion 28*b* on which the underside of the drawer bottom rests in the proper connection position two more holes 34—which can be seen in FIGS. 6 and 7—are punched in, which—in special cases—make possible an additional connection of the drawer bottom to the connector component 14, as a fixing screw—not shown—can be screwed into the drawer bottom from the underside of the leg portion 28*b* in each case.

FIG. 11 shows a view corresponding to that of FIG. 3 of the connection of the drawer frame 12 to the drawer bottom 10, in which the drawer pull-out guide 40 which is inserted into the frame from the underside and is shown as a full pull-out means is additionally shown as well as the fixing thereof on the adjacent carcass wall 42 of the piece of furniture in which the pull-out guide is retained. The pull-out guide 40 is installed in the carcass by means of fixing angle members 46 which can be attached to the underside of the guide rail 44 fixed to the carcass on the one hand and to the inner face of the carcass wall 42 on the other hand.

The elongate low housing 48 of an automatic drawer retraction device 50—illustrated schematically in FIG. 11—which is positioned adjacent to the supporting leg 28 on the underside of the drawer bottom 10 in the proper functioning position is shown on the underside of the supporting flange 28 of the connector component 14. Since the basic construction and operation of such automatic retraction devices are known per se they are not described in detail here. The pawl component 52 which triggers the automatic retraction device connected to the drawer as it approaches the closed position of the drawer projects out of the housing 48 in the direction of the guide rail 44. In the appropriate triggering position a catch 54, which projects into the path of the pawl component 52 and approaches the pawl component 52 in the triggering position, is fixed on the underside of the guide rail 44, as can be seen in the view from below in FIG. 11 which is reproduced on an enlarged scale in FIG. 12.

The housing 48 of the automatic retraction device 50 is latched with the supporting leg 28 in the region aligned with the appertaining connector component, and an additional fixing is effected on the inner wall of the drawer frame 12 in the part of the housing 48 which is extended over the supporting leg 28. This fixing is effected by means of a tongue 58 which is formed integrally on the housing 48 and which can be pushed into a corresponding receptacle formed out of the inner wall of the drawer frame 12.

It can be seen that within the scope of the idea underlying the invention modifications and variants can be made to the described connecting arrangement. In the foregoing description the connection of the drawer bottom to a side wall frame is described. It is clear that a frame which forms the drawer rear wall can also be connected to the drawer bottom in the same way. The additional fixing of a fitting which is to be disposed in the interior of the hollow chamber profile forming the drawer frame 12 is shown in FIG. 4 above the right-hand connecting component 14 shown in the drawing. In the illustrated case this is a connecting fitting 38 which makes possible an adjustable installation of the front panel of a drawer on the right-hand end of the drawer frame 12.

When a plurality of connector components 14 are used which are inserted so as to be offset in the longitudinal direction into the underside of the drawer frame 12, it is also possible for only one sheet metal profile corresponding to the described part-profile 16 to be used as the drawer frame 12. The function of stabilising the part-profile 18 which in the illustrated embodiment is inserted into the part-profile 16 is then carried out by the connector components 14.

The invention claimed is:

1. A connector component for connecting a drawer frame (12) to a drawer bottom (10), the arrangement comprising:

a strip-shaped vertical contact web (26) having a lower end; and a supporting leg (28) projecting from the lower end of the contact web (26), the supporting leg (28) including an inner strip-shaped leg portion (28*a*) having a first edge directly adjoining the lower end of the contact web (26) and an outer strip-shaped leg portion (28*b*) farthest away from the contact web (26), the outer strip-shaped leg portion (28*b*) having a free edge and an opposite edge directly adjoining a second edge of the inner strip-shaped leg portion opposite its first edge, the inner and outer strip-shaped leg portions (28*a*, 28*b*) being substantially parallel but offset relative to one another with the inner strip-shaped leg portion (28*a*) being offset a greater distance relative to the lower end of the contact web (26) than that of the outer strip-shaped leg portion (28*b*); the support leg (28) having at least one fixing claw (32) with pointed free ends integrally punched-out and projecting substantially perpendicularly therefrom, the supporting leg (28) having at least one elongate punched-out slot (30) defined therein between the lower end of the contact web (26) and the free edge of the outer strip-shaped leg portion (28*b*), the outer strip-shaped leg portion (28*b*) extending longitudinally the entire length of the inner strip-shaped leg portion (28*a*) and the outer strip-shaped leg portion (28*b*) being substantially planar prior to assembly.

2. A connector component for connecting a drawer frame (12) to a drawer bottom (10), the arrangement comprising:

a strip-shaped vertical contact web (26) having a lower end; and a supporting leg (28) projecting from the lower end of the contact web (26), the supporting leg (28) including an inner strip-shaped leg portion (28*a*) having a first edge directly adjoining the lower end of the contact web (26) and an outer strip-shaped leg portion (28*b*) farthest away from the contact web (26), the outer strip-shaped leg portion (28*b*) having a free edge and an opposite edge directly adjoining a second edge of the inner strip-shaped leg portion opposite its first edge, the inner and outer strip-shaped leg portions (28*a*, 28*b*) being substantially parallel but offset relative to one another with the inner strip-shaped leg portion (28*a*) being offset a greater distance relative to the lower end of the contact web (26) than that of the outer strip-shaped leg portion (28*b*); the support leg (28) having at least one fixing claw (32) with pointed free ends integrally punched-out and projecting substantially perpendicularly therefrom, the supporting leg (28) having at least one elongate punched-out slot (30) defined therein between the lower end of the contact web (26) and the free edge of the outer strip-shaped leg portion (28*b*), the punched-out slot (30) is provided in the supporting leg (28) in a junction region between the inner and outer strip-shaped leg portions (28*a*, 28*b*) with the at least one fixing claw (32) projecting integrally from an edge of the punched-out slot (30) which extends substantially parallel to the contact web (26).

3. The connector component in accordance with claim 2, wherein the at least one fixing claw (32) comprises at least one pair of substantially parallel fixing claws spaced apart from one another from the edge of the punched-out slot (30).

4. The connector component in accordance with claim 2, wherein the at least one fixing claw (32) is formed by tab-shaped extensions formed from material of the supporting leg (28) punched-out from the slot (30), and the free ends of the at least one fixing claw is chamfered to form a point.

5. The connector component in accordance with claim 4, wherein the chamfer of the free end of one of the fixing claws (32) extends in a direction opposite to the chamfer of another fixing claw (32) so that the free ends of the fixing claws deform in opposite directions upon the application of force.

6. The connector component in accordance with claim 5, wherein the outer strip-shaped leg portion (28*b*) of the supporting leg (28) has at least one hole (34) defined therethrough.

7. The connector component in accordance with claim 6, wherein the connector component (14) is punched pressed from sheet metal and is configured in its region to be installed along an underside of the drawer frame (12) to have a cross-section corresponding to an internal cross-section of a region of a hollow chamber profile of the drawer frame (12) in which the connector component (14) is received.

8. An assembled furniture structure comprising:

a drawer frame (12) formed by a metal hollow chamber profile;

a plate-shaped drawer bottom (10) having a facing lateral edge; and a connecting component (14) connecting the drawer frame (12) to the facing lateral edge of the drawer bottom (10), the connecting component (14) comprising:

a strip-shaped vertical contact web (26) having a lower end;

a supporting leg (28) projecting from the lower end of the contact web (26), the supporting leg (28) including an inner strip-shaped leg portion (28*a*) having a first edge directly adjoining the lower end of the contact web (26) and an outer strip-shaped leg portion (28*b*) farthest away from the contact web (26), the outer strip-shaped leg portion (28*b*) having a free edge and an opposite edge directly adjoining a second edge of the inner strip-shaped leg portion opposite its first edge, the inner and outer strip-shaped leg portions (28*a*, 28*b*) being substantially parallel but offset relative to one another with the inner strip-shaped leg portion (28*a*) being offset a greater distance relative to the lower end of the contact web (26) than that of the outer strip-shaped leg portion (28*b*); the support leg (28) having at least one fixing claw (32) with pointed free ends integrally punched-out and projecting substantially perpendicularly therefrom, the supporting leg (28) having at least one elongate punched-out slot (30) defined therein between the lower end of the contact web (26) and the free edge of the outer strip-shaped leg portion (28*b*), the outer strip-shaped leg portion (28*b*) extending longitudinally the entire length of the inner strip-shaped leg portion (28*a*) and the outer strip-shaped leg portion (28*b*) being substantially planar prior to assembly.

9. The assembled furniture structure in accordance with claim 8, further comprising a connecting fitting (38) disposed interiorly of the hollow chamber profile forming the drawer frame (12).

10. The assembled furniture structure in accordance with claim 8, further comprising:

a guide rail (44) received within the drawer frame (12); and an automatic drawer retraction device (50) having a housing (48), a pawl component (52) for triggering a retraction function, and a catch (54) disposed on the guide rail (44); the housing (48) of the automatic drawer retraction device (50) being disposed on an underside, facing away from the drawer bottom, of the supporting leg (28) of the connector component (14) so that the pawl component (52) projects, during pull-out or push-in movement of the drawer bottom (10), into a path of the catch (54).

11. The assembled furniture structure in accordance with claim 10, further comprising a damping device provided in the housing (48) for slowing down the retraction function of the pawl component (52) after it has been triggered by the catch (54).

12. The assembled furniture structure in accordance with claim 11, wherein the damping device is provided with a damper and has a fluid or gaseous damping medium.

13. The assembled furniture structure in accordance with claim 10, wherein the housing (48) of the automatic retraction device (50) is mounted to the supporting leg (28) of the connector component (14).

14. The assembled furniture structure in accordance with claim 13, wherein the housing (48) of the automatic retraction device (50) has an additional connection to the drawer frame (12) in its region which projects over the supporting leg (28) in the pull-out or retraction directional movement of the drawer bottom (10).

15. The assembled furniture structure in accordance with claim 14, wherein the additional connection of housing (48) of the automatic retraction device (50) to the drawer frame (12) is a tongue (58) that projects from the housing (48), pointing in the pull-out or retraction directional movement of the drawer bottom (10) and is received within a receptacle defined in the drawer frame (12).

16. A connector component for connecting a drawer frame (12) to a drawer bottom (10), the arrangement comprising:

a strip-shaped vertical contact web (26) having a lower end; and a supporting leg (28) projecting from the lower end of the contact web (26), the supporting leg (28) including an inner strip-shaped leg portion (28*a*) having a first edge directly adjoining the lower end of the contact web (26) and an outer strip-shaped leg portion (28*b*) farthest away from the contact web (26), the outer strip-shaped leg portion (28*b*) having a free edge and an opposite edge directly adjoining a second edge of the inner strip-shaped leg portion opposite its first edge, the inner and outer strip-shaped leg portions (28*a*, 28*b*) being substantially parallel but offset relative to one another with the inner strip-shaped leg portion (28*a*) being offset a greater distance relative to the lower end of the contact web (26) than that of the outer strip-shaped leg portion (28*b*); the support leg (28) having at least one fixing claw (32) with pointed free ends integrally punched-out and projecting substantially perpendicularly therefrom, the supporting leg (28) having at least one elongate punched-out slot (30) defined therein between the lower end of the contact web (26) and the free edge of the outer strip-shaped leg portion (28*b*), the outer strip-shaped leg portion (28*b*) extending longitudinally the entire length of the inner strip-shaped leg portion (28*a*) and the free edge of the outer strip-shaped leg portion (28*a*) being substantially linear.

17. An assembled furniture structure comprising:

a drawer frame (12) formed by a metal hollow chamber profile;

a plate-shaped drawer bottom (10) having a facing lateral edge; and a connecting component (14) connecting the drawer frame (12) to the facing lateral edge of the drawer bottom (10), the connecting component (14) comprising:

a strip-shaped vertical contact web (26) having a lower end;

a supporting leg (28) projecting from the lower end of the contact web (26), the supporting leg (28) including an inner strip-shaped leg portion (28*a*) having a first edge directly adjoining the lower end of the contact web (26) and an outer strip-shaped leg portion (28*b*) farthest away from the contact web (26), the outer strip-shaped leg portion (28*b*) having a free edge and an opposite edge directly adjoining a second edge of the inner strip-shaped leg portion opposite its first edge, the inner and outer strip-shaped leg portions (28*a*, 28*b*) being substantially parallel but offset relative to one another with the inner strip-shaped leg portion (28*a*) being offset a greater distance relative to the lower end of the contact web (26) than that of the outer strip-shaped leg portion (28*b*); the support leg (28) having at least one fixing claw (32) with pointed free ends integrally punched-out and projecting substantially perpendicularly therefrom, the supporting leg (28) having at least one elongate punched-out slot (30) defined therein between the lower end of the contact web (26) and the free edge of the outer strip-shaped leg portion (28*b*), the outer strip-shaped leg portion (28*b*) extending longitudinally the entire length of the inner strip-shaped leg portion (28*a*) and the free edge of the outer strip-shaped leg portion (28*a*) being substantially linear.

18. An assembled furniture structure comprising:

a drawer frame (12) formed by a metal hollow chamber profile;

a plate-shaped drawer bottom (10) having a facing lateral edge; and a connecting component (14) connecting the drawer frame (12) to the facing lateral edge of the drawer bottom (10), the connecting component (14) comprising:

a strip-shaped vertical contact web (26) having a lower end;

a supporting leg (28) projecting from the lower end of the contact web (26), the supporting leg (28) including an inner strip-shaped leg portion (28*a*) having a first edge directly adjoining the lower end of the contact web (26) and an outer strip-shaped leg portion (28*b*) farthest away from the contact web (26), the outer strip-shaped leg portion (28*b*) having a free edge and an opposite edge directly adjoining a second edge of the inner strip-shaped leg portion opposite its first edge, the inner and outer strip-shaped leg portions (28*a*, 28*b*) being substantially parallel but offset relative to one another with the inner strip-shaped leg portion (28*a*) being offset a greater distance relative to the lower end of the contact web (26) than that of the outer strip-shaped leg portion (28*b*); the support leg (28) having at least one fixing claw (32) with pointed free ends integrally punched-out and projecting substantially perpendicularly therefrom, the supporting leg (28) having at least one elongate punched-out slot (30) defined therein between the lower end of the contact web (26) and the free edge of the outer strip-shaped leg portion (28*b*), the punched-out slot (30) is provided in the supporting leg (28) in a junction region between the inner and outer strip-shaped leg portions (28*a*, 28*b*) with the at least one fixing claw (32) projecting integrally from an edge of the punched-out slot (30) which extends substantially parallel to the contact web (26).

* * * * *

UNITED STATES PATENT AND TRADEMARK OFFICE

CERTIFICATE OF CORRECTION

PATENT NO. : 7,455,374 B2
APPLICATION NO. : 10/518311
DATED : November 25, 2008
INVENTOR(S) : Nachbaur et al.

It is certified that error appears in the above-identified patent and that said Letters Patent is hereby corrected as shown below:

On the title page, Abstract (57) line 2, "hallow" should read -- hollow --

Signed and Sealed this

Twenty-fifth Day of August, 2009

David J. Kappos

David J. Kappos
*Director of the United States Patent and Trademark Office*